US009573778B2

(12) United States Patent
Tomaru

(10) Patent No.: US 9,573,778 B2
(45) Date of Patent: Feb. 21, 2017

(54) PAPER FEED DEVICE AND PAPER FEED METHOD

(71) Applicant: KYOCERA Document Solutions Inc., Osaka (JP)

(72) Inventor: Akitomo Tomaru, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/924,160

(22) Filed: Oct. 27, 2015

(65) Prior Publication Data

US 2016/0122141 A1 May 5, 2016

(30) Foreign Application Priority Data

Oct. 31, 2014 (JP) ..... 2014-223290

(51) Int. Cl.

| | |
|---|---|
| ***B65H 1/08*** | (2006.01) |
| ***B65H 1/24*** | (2006.01) |
| ***B65H 1/14*** | (2006.01) |
| ***B65H 1/26*** | (2006.01) |
| ***B65H 7/00*** | (2006.01) |

(52) U.S. Cl.

CPC *B65H 1/24* (2013.01); *B65H 1/08* (2013.01); *B65H 1/14* (2013.01); *B65H 1/266* (2013.01); *B65H 7/00* (2013.01); *B65H 2402/543* (2013.01); *B65H 2403/513* (2013.01); *B65H 2405/1119* (2013.01); *B65H 2405/11161* (2013.01); *B65H 2405/15* (2013.01);

(Continued)

(58) Field of Classification Search

CPC ..... B65H 1/08; B65H 1/12; B65H 1/24; B65H 1/18; B65H 2405/11161; B65H 2405/1119

USPC ..... 271/209

See application file for complete search history.

(56) References Cited

U.S. PATENT DOCUMENTS 1,685,799 A * 10/1928 Baker ..... B65H 1/04 271/148
4,400,124 A * 8/1983 Greller ..... B65H 31/02 271/209

(Continued)

FOREIGN PATENT DOCUMENTS

| | | | |
|---|---|---|---|
| JP | 2001-88968 | A | 4/2001 |
| JP | 2007-191264 | A | 8/2007 |
| JP | 2009-249175 | A | 10/2009 |

OTHER PUBLICATIONS

Japanese Office Action dated Aug. 1, 2016, issued by the Japanese Patent Office in corresponding application JP 2014-223290.

*Primary Examiner* — Jeremy R Severson
(74) *Attorney, Agent, or Firm* — Stein IP, LLC

(57) ABSTRACT

A paper feed device and a paper feed method that, even in a case where the number of paper sheets remaining on a paper sheet stacking plate is low, allow paper sheet changing to be facilitated. There are included a paper sheet push-up member for pushing up from below a paper sheet batch on the paper sheet stacking plate and a push-up member driving device that, in a case where the number of paper sheets in the paper sheet batch on the paper sheet stacking plate is not higher than the prescribed number, makes at least a part of the paper sheet push-up member protrude upward beyond the upper surface of the paper sheet stacking plate. Thus, a lower surface of the paper sheet batch placed on the paper sheet stacking plate is pushed up from below, thereby creating a clearance.

3 Claims, 10 Drawing Sheets

(52) U.S. Cl.
CPC ..... *B65H 2511/15* (2013.01); *B65H 2511/30* (2013.01); *B65H 2601/325* (2013.01)

(56) References Cited

U.S. PATENT DOCUMENTS

| | | | | | |
|---|---|---|---|---|---|
| 6,000,866 | A * | 12/1999 | Funaki | B41J 11/0005 | 271/188 |
| 6,139,008 | A * | 10/2000 | Margiotta | B65H 1/04 | 271/147 |
| 6,283,469 | B1 * | 9/2001 | Weber | B65H 1/18 | 271/148 |
| 6,629,693 | B2 * | 10/2003 | Siow | B65H 1/12 | 271/148 |
| 7,458,574 | B2 * | 12/2008 | Wilcox | B65H 1/14 | 271/148 |
| 7,464,925 | B2 * | 12/2008 | Dobbertin | B65H 1/04 | 271/148 |
| 9,126,782 | B2 * | 9/2015 | Abe | B65H 1/08 | |
| 9,272,857 | B2 * | 3/2016 | Nakagawa | B65H 1/12 | |
| 2010/0001457 | A1 * | 1/2010 | Yamagata | B65H 1/266 | 271/126 |
| 2014/0321877 | A1 * | 10/2014 | Ono | G03G 15/6552 | 399/92 |

* cited by examiner

PAPER FEED DEVICE AND PAPER FEED METHOD

INCORPORATION BY REFERENCE

This application is based on and claims the benefit of priority from Japanese Patent Application No. 2014-223290 filed on Oct. 31, 2014, the contents of which are hereby incorporated by reference.

BACKGROUND

The present disclosure relates to a paper feed device and a paper feed method.

Conventionally, as a paper feed cassette incorporated in an image forming apparatus such as a copy machine, a printer, or the like, there is known a paper feed cassette having a paper sheet housing case that is open upward and a paper sheet stacking plate that is configured to be movable in an up-down direction in said paper sheet housing case. On an upper surface of the paper sheet stacking plate, a batch of paper sheets are placed in a state of being stacked. The paper sheet stacking plate is linked to a motor via wire. By a driving force of the motor, the paper sheet stacking plate is caused to ascend as the number of paper sheets decreases so that an uppermost one of paper sheets placed on the paper sheet stacking plate is always positioned at a paper feed position. At this paper feed position, a pick-up roller is provided by which an uppermost one of paper sheets in a paper sheet batch is separated from the paper sheet batch to be fed to a paper sheet conveying path.

The above-described conventional paper feed device, however, presents a problem that at the time of paper sheet changing by a user, in a case where the number of paper sheets remaining on the paper sheet stacking plate is low, compared with a case where a sufficient number of paper sheets are remaining there, it is hard for the user to insert his/her finger(s) between a lowermost one of the paper sheets and the paper sheet stacking plate and thus to grasp the paper sheets. The above-described paper feed device, therefore, is susceptible to improvement from the standpoint of facilitating a paper sheet changing procedure by a user.

A paper feed device according to one aspect of the present disclosure includes a paper sheet housing case, a paper sheet stacking plate, and a lift-up mechanism. The paper sheet housing case is open upward. The paper sheet stacking plate is provided in the paper sheet housing case in such a manner as to be movable in an up-down direction, and on an upper surface thereof, a batch of paper sheets are placed in a state of being stacked in the up-down direction. The lift-up mechanism causes said paper sheet stacking plate to ascend as the number of the paper sheets on the paper sheet stacking plate decreases so that an uppermost one of the paper sheets in the paper sheet batch on said paper sheet stacking plate is positioned at a prescribed paper feed height.

The above-described paper feed device further includes a push-up member for pushing up from below a paper sheet batch on the paper sheet stacking plate and a push-up member driving device that, in a case where the number of paper sheets in the paper sheet batch on the paper sheet stacking plate is higher than a prescribed number, causes the push-up member to be positioned not higher than the upper surface of the paper sheet stacking plate, and in a case where the number of paper sheets in the paper sheet batch on the paper sheet stacking plate is not higher than the prescribed number, makes at least a part of the push-up member protrude upward beyond the upper surface of the paper sheet stacking plate so that a part of a lower surface of a lowermost one of the paper sheets in the paper sheet batch placed on the paper sheet stacking plate is pushed up from below by said push-up member, thereby creating a clearance between the lower surface of the lowermost one of the paper sheets and the upper surface of the paper sheet stacking plate.

A paper feed method according to one aspect of the present disclosure is a paper feed method for the paper feed device having the configuration, in which via the push-up member and push-up member driving device, in a case where the number of paper sheets in a paper sheet batch on the paper sheet stacking plate is higher than a prescribed number, the above-described push-up member is caused to be positioned not higher than the upper surface of the paper sheet stacking plate, and in a case where the number of paper sheets in the paper sheet batch on the paper sheet stacking plate is not higher than the prescribed number, at least a part of the push-up member is made to protrude upward beyond the upper surface of the paper sheet stacking plate so that a part of a lower surface of a lowermost one of the paper sheets in the paper sheet batch placed on the paper sheet stacking plate is pushed up from below by the push-up member, thereby creating a clearance between the lower surface of the lowermost one of the paper sheets and the upper surface of the paper sheet stacking plate.

DETAILED DESCRIPTION

With reference to the appended drawings, the following describes embodiments of the present disclosure. The present disclosure, however, is not limited to the following embodiments.

Embodiment 1

Figure 1:
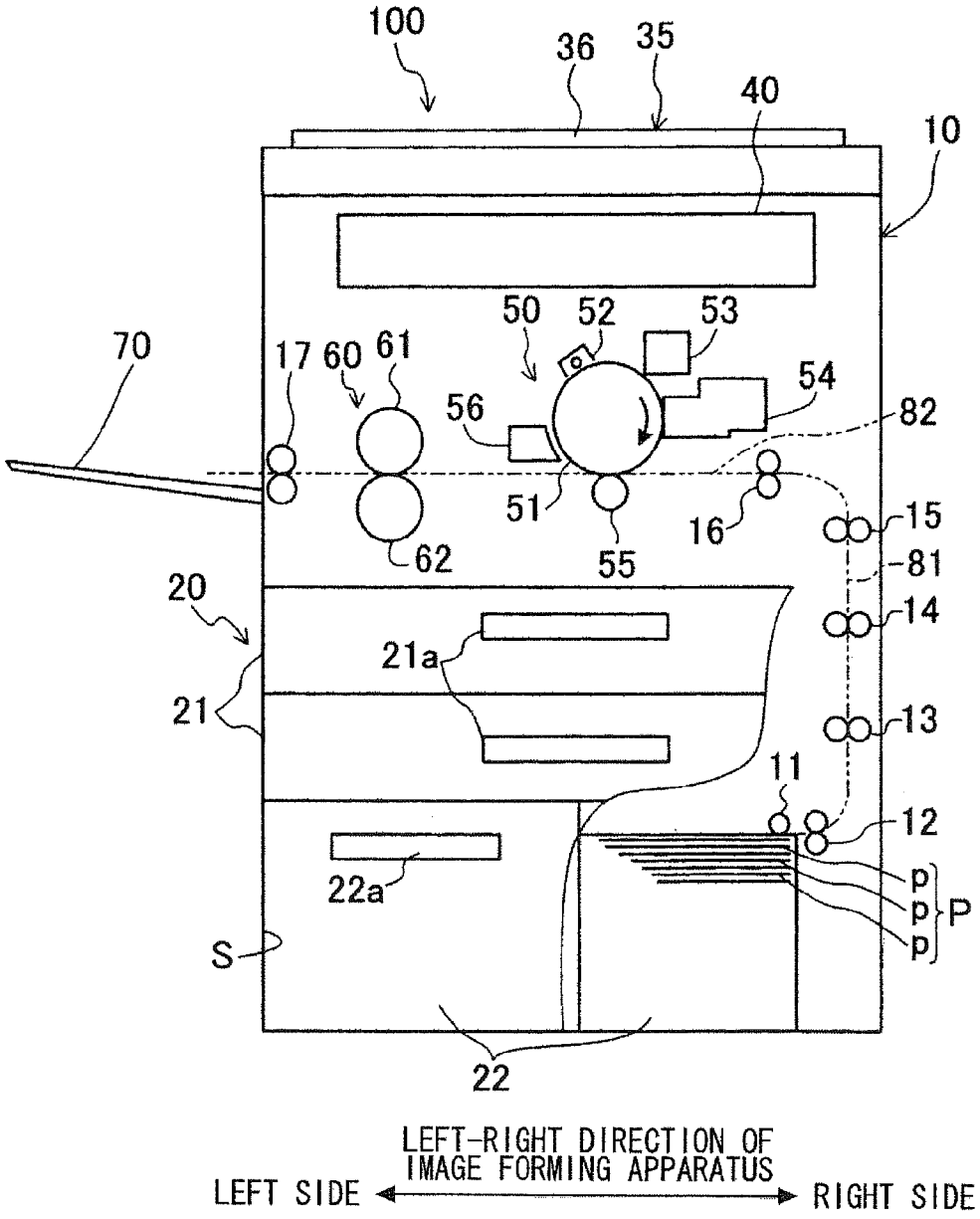
FIG. 1 is a schematic view showing an image forming apparatus in an embodiment of the present disclosure as seen from an apparatus front side.

FIG. 1 shows an image forming apparatus 100 in this embodiment. This image forming apparatus 100 has a housing 10, a paper feed portion 20 (including the paper feed device of the present application), an original document setting portion 35, an image reading portion 40, an image forming portion 50, a fixing portion 60, and a paper ejection portion 70. In the following description, it is assumed that a "front side" and a "back side" refer to a front side and a back side of the image forming apparatus 100 (a closest side and a farthest side in a direction orthogonal to the plane of FIG. 1), respectively, and a "left side" and a "right side" refer to a left side and a right side when the image forming apparatus 100 is seen from the front side (a left side and a right side in FIG. 1), respectively.

The housing 10 is formed of a box-shaped body made of sheet metal. The paper feed portion 20 is provided at a lower portion in the housing 10. In the paper feed portion 20, paper sheets for printing are housed. The original document setting portion 35 has an original document placing surface that is translucent and is formed on an upper surface of the housing 10 and an original document press-holding cover 36 that covers the original document placing surface in such a manner as to be freely openable and closable. The original document reading portion 40 is disposed at an upper portion in the housing 10 and optically reads an image on an original document set on the original document placing surface. The image forming portion 50 is disposed on a lower side of the original document reading portion 40 in the housing 10. The image forming portion 50 applies, from an exposure device 53, laser light corresponding to image data of the original document read by the original document reading portion 40 to a surface of a photosensitive drum 51 and thus forms an electrostatic latent image thereon. The image forming portion 50 makes a developer 54 develop the electrostatic latent image formed on the surface of the photosensitive drum 51 into a toner image. Further, in the image forming portion 50, a paper sheet p conveyed from the paper feed portion 20 by a registration roller pair 16 is conveyed while being sandwiched between the photosensitive drum 51 and a transfer roller 55, and thus the toner image is transferred onto the paper sheet p. In the figure, reference symbol 52 denotes a charger that charges the surface of the photosensitive drum 51 before being subjected to exposure, and reference symbol 56 denotes a cleaning device for eliminating residual toner remaining on the surface of the photosensitive drum 51.

In the fixing portion 60, the paper sheet onto which the toner image has been transferred is pressed between a fixing roller 61 and a pressing roller 62, and thus the toner image is fixed on the paper sheet. The paper sheet on which the toner image has been fixed at the fixing portion 60 is ejected to the paper ejection portion 70 by a paper ejection roller pair 17.

The paper feed portion 20 has two conventional paper feed cassettes 21 and two large capacity paper feed cassettes 22. On a lower side of the image forming portion 50 in the housing 10, the two conventional paper feed cassettes 21 are disposed in upper and lower two stages. On a lower side of the conventional paper feed cassettes 21, the two large capacity paper feed cassettes 22 are disposed side by side. The large capacity paper feed cassettes 22 have a depth from an upper end thereof to a bottom wall thereof that is set to be 2.5 times to 3 times that of the conventional paper feed cassettes 21. This makes it possible for the large capacity paper feed cassettes 22 to house a larger number of the paper sheets p than in the conventional paper feed cassettes 21. On a lower side of the image forming portion 50 in the housing 10, a cassette housing space S is provided that is open frontward. The paper feed cassettes 21 and 22 are housed in this cassette housing space S. In the cassette housing space S, unshown guide rails are provided that support the paper feed cassettes 21 and 22 in such a manner that they are slidable in a front-back direction. The paper feed cassettes 21 and 22 are demountable by being pulled out, from a state of being mounted in the housing 10 (a state shown in FIG. 1), frontward along said guide rails. That is, the paper feed cassettes 21 and 22 are mountable and demountable with respect to the housing 10. In the figure, reference symbols 21*a* and 22*a* denote handles formed on front side surfaces of the paper feed cassettes 21 and 22, respectively.

In each of the paper feed cassettes 21 and 22, as a paper sheet batch P, the paper sheets p of a different size are housed in such a manner as to be stacked in an up-down direction. By a pick-up roller 11 and a paper feed roller pair 12 (FIG. 1 shows only the pick-up roller 11 and the paper feed roller pair 12 of the large capacity paper feed cassette 21 on a right side) disposed in a vicinity of an upper end portion of each of the paper feed cassettes 21 and 22, the paper sheet p in each of the paper feed cassettes 21 and 22 is guided to a vertical conveyance path 81 disposed at a right side end portion in the housing 10. Then, by a plurality of conveyance roller pairs 13 to 15 disposed along the vertical conveyance path 81, the paper sheet p is guided to a horizontal conveyance path 82. The horizontal conveyance path 82 is a conveyance path connecting an upper end portion of the vertical conveyance path 81 to the paper ejection portion 70, along which the paper sheet conveyed from the vertical conveyance path 81 is supplied by the registration roller pair 16 to the image forming portion 50 and then is ejected by the paper ejection roller pair 17 to the paper ejection portion 70.

Figure 2:
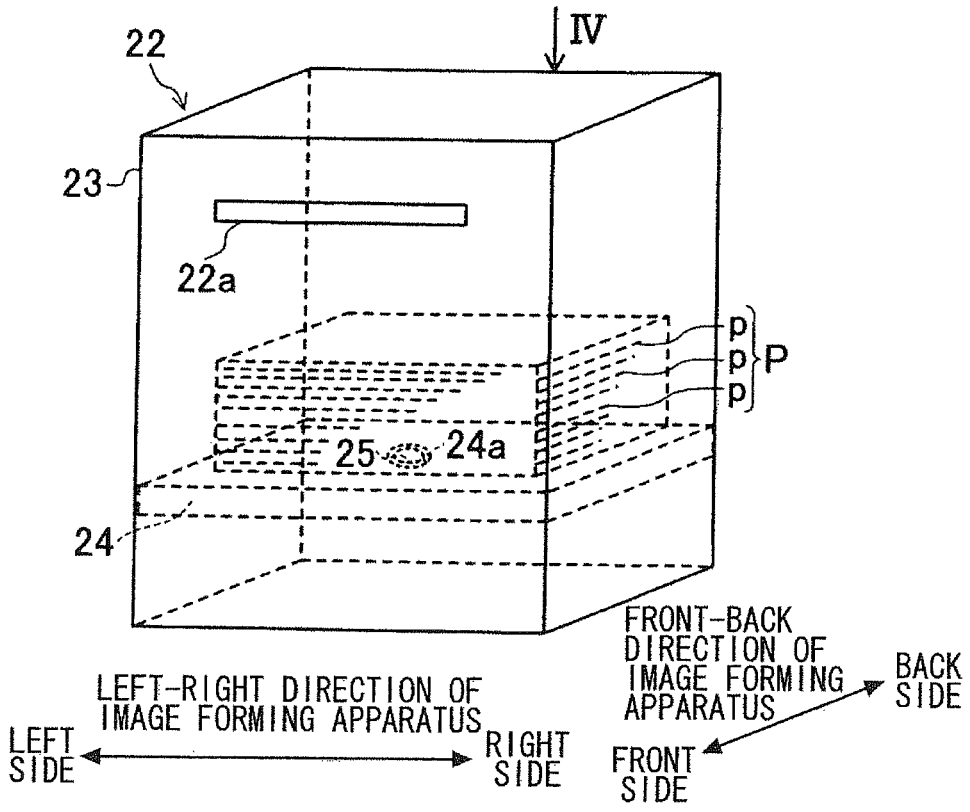
FIG. 2 is a perspective view schematically showing a large capacity paper feed cassette mounted in the image forming apparatus.

With reference to FIG. 2, a description is made of a configuration of the large capacity paper feed cassettes 22. Since the large capacity paper feed cassettes 22 on the left and right are the same in configuration, the following describes only the large capacity paper feed cassette 22 on the right side and omits a description of the large capacity paper feed cassette 22 on the left side.

That is, the large capacity paper feed cassette 22 has a rectangular box-shaped paper sheet housing case 23 that is open upward and a paper sheet stacking plate 24 that is housed in the paper sheet housing case 23 and is movable in the up-down direction. The paper sheet stacking plate 24 is formed of a rectangular plate somewhat larger than a prescribed size (for example, A4, B4, or the like) of paper sheets housed in the paper sheet housing case 23. On a back side surface of the paper sheet housing case 23, there is provided a lift-up mechanism 90 (see FIG. 3) for moving up and down the paper sheet stacking plate 24 in the paper sheet housing case 23.

Figure 3:
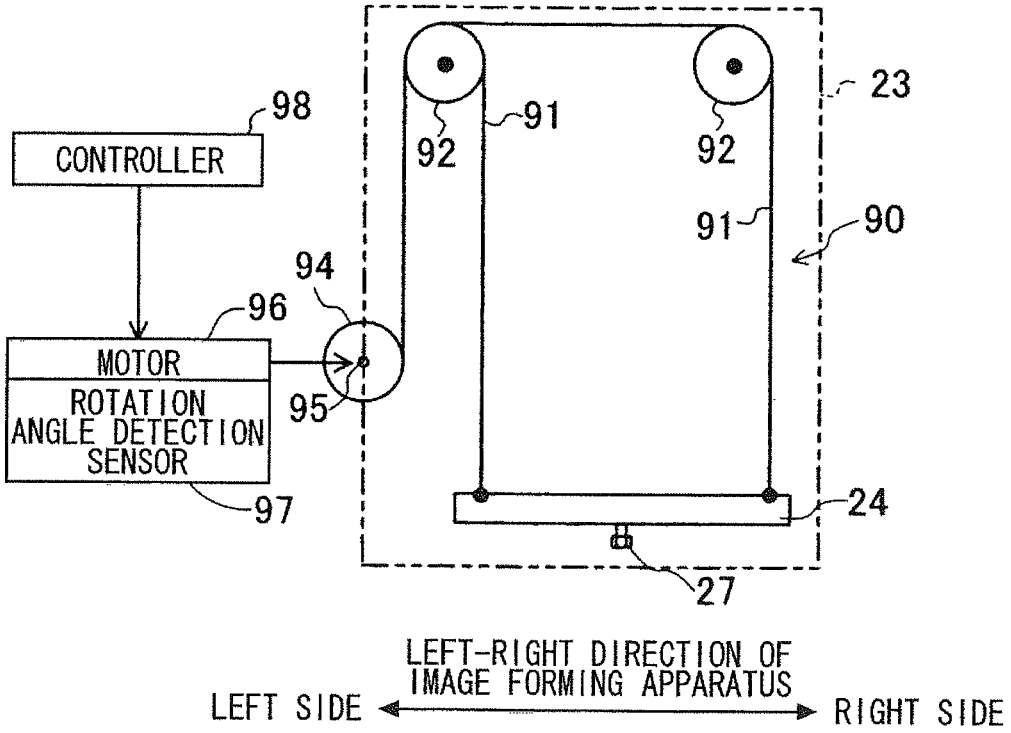
FIG. 3 is a schematic view showing a lift-up mechanism of a paper sheet stacking plate in the large capacity paper feed cassette.

As shown in FIG. 3, the lift-up mechanism 90 has a left-right pair of wires 91, a left-right pair of intermediate pulleys 92, a driving pulley 94, and a driving shaft 95. One end portion of each of the wires 91 is connected to a back end portion of the paper sheet stacking plate 24. Each of the intermediate pulleys 92 is rotatably mounted to the back side surface of the paper sheet housing case 23, and on each of the intermediate pulleys 92, an intermediate portion of each of the wires 91 is wound to be supported. The other end portion of each of the wires 91 is wound around the driving pulley 94. The driving pulley 94 is rotatably mounted to the back side surface of the paper sheet stacking plate 24. The driving shaft 95 is linked to the driving pulley 94 in such a manner as to be rotatable integrally with the driving pulley 94. When the large capacity paper feed cassette 22 is inserted into the cassette housing space S, the driving shaft 95 is linked to a motor 96 that is fastened in the housing 10. This makes it possible to transmit power from the motor 96 to the driving pulley 94. The motor 96 is controlled to be activated by a controller 98. The controller 98 is connected to, in addition to the motor 96, a rotation angle detection sensor 97. The rotation angle detection sensor 97 detects an rpm (rotation angle) of the motor 96 and outputs a detection signal representing a result of the detection. The controller 98 calculates, based on the signal from the rotation angle detection sensor 97, a distance from an upper surface of the paper sheet stacking plate 24 to a paper feed position and calculates, based on the calculated distance, the number of paper sheets on the paper sheet stacking plate 24.

When the large capacity paper feed cassette 22 is inserted into the cassette housing space S and thus the driving shaft 95 is linked to the motor 96, the controller 98 controls the motor 96 to rotate the driving pulley 94 in a clockwise direction in FIG. 3 so that the wires 91 are wound up by the driving pulley 94. In this way, the controller 98 causes said paper sheet stacking plate 24 to ascend to such an extent that an uppermost one of the paper sheets p on the paper sheet stacking plate 24 comes in contact with the pick-up roller 11 provided at the paper feed position. The controller 98 drives the motor 96 to cause the paper sheet stacking plate 24 to ascend as the number of the paper sheets p on the paper sheet stacking plate 24 decreases so that an uppermost one of the paper sheets p is always in contact with the pick-up roller 11. On the other hand, when the large capacity paper feed cassette 22 is demounted from the housing 10, linkage between the driving shaft 95 and the motor 96 is released, so that the paper sheet stacking plate 24 descends under its own weight to a bottom portion of the paper sheet housing case 23 and, upon coming in contact with a stopper member (a depiction thereof is omitted), stops descending at a prescribed standby position.

Figure 4:
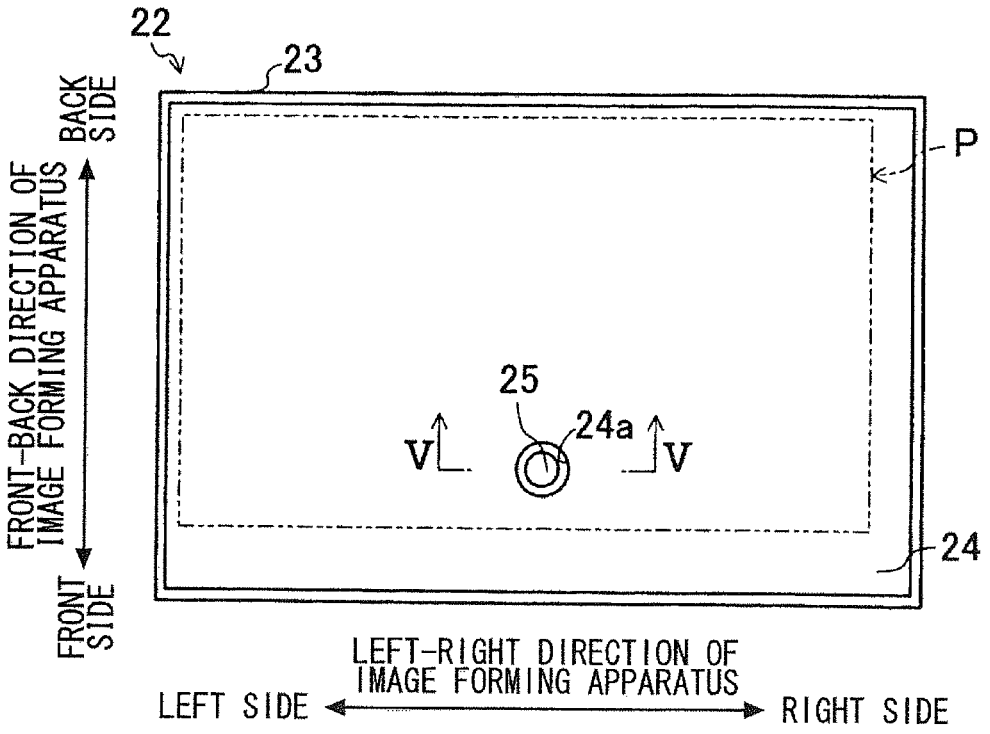
FIG. 4 is a view seen in a IV direction indicated by an arrow in FIG. 2.
Figure 5A:
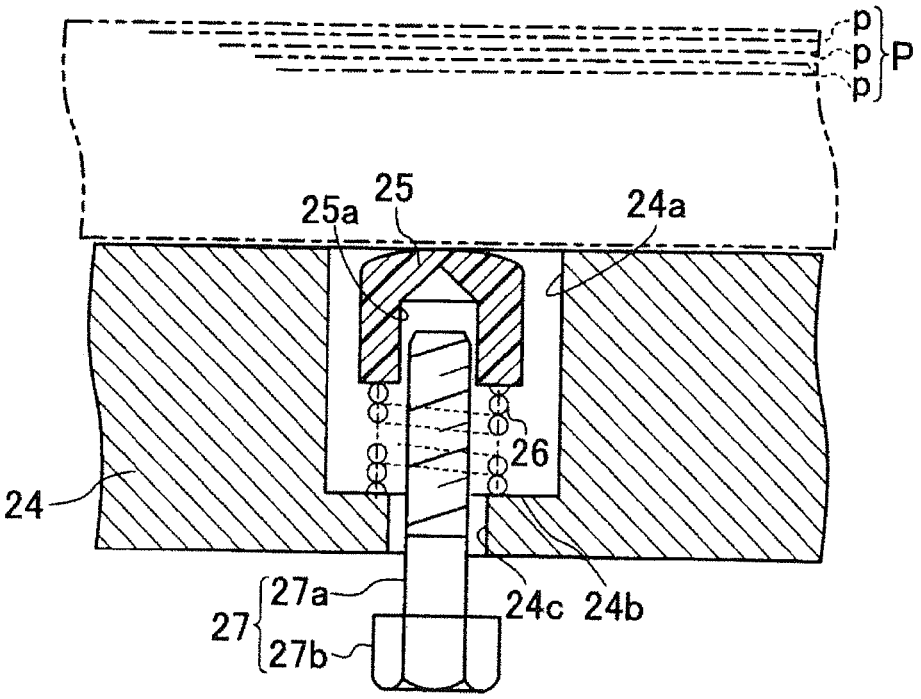
FIG. 5A is a sectional view taken along a line V-V in FIG. 4, which shows a case where the number of paper sheets in a paper sheet batch is higher than a prescribed number.
Figure 5B:
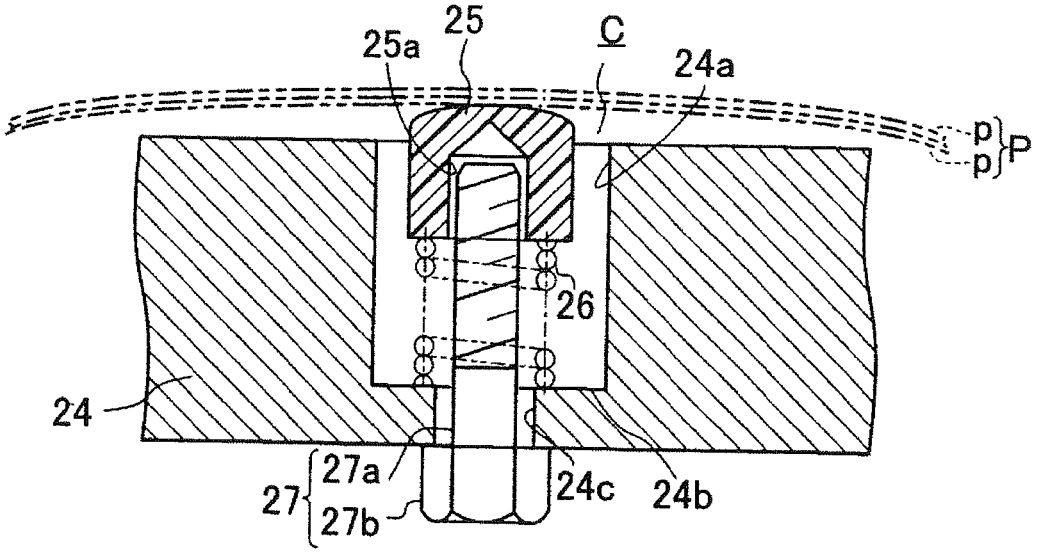
FIG. 5B is a sectional view taken along the line V-V in FIG. 4, which shows a case where the number of paper sheets in a paper sheet batch is not higher than a prescribed number.

As shown in FIG. 4, at a front side end portion in an area on the paper sheet stacking plate 24 on which the paper sheet batch P is placed, at a center portion in a left-right direction therein, a paper sheet push-up member 25 (corresponding to the push-up member of the present application) is provided. The paper sheet push-up member 25 is formed of a substantially cylindrical resin member whose axis extends in the up-down direction. An upper end portion of the paper sheet push-up member 25 is formed in a spherical surface shape (one example of a curved surface shape). As shown in FIG. 5A and FIG. 5B, the paper sheet push-up member 25 is supported by a compression coil spring 26. The compression coil spring 26 is housed in a housing concave portion 24*a* that is formed at an upper surface of the paper sheet stacking plate 24 (a surface on which the paper sheet p is stacked). The housing concave portion 24*a* is a cylindrical concave portion that is open upward. A through hole 24*c* is formed to penetrate in the up-down direction through a bottom surface 24*b* of the housing concave portion 24*a*. The through hole 24*c* is formed coaxially with the housing concave portion 24*a*. A bolt 27 is inserted from below through the through hole 24*c*. The bolt 27 has a substantially columnar bolt shaft portion 27*a* and a bolt head portion 27*b* that is formed at a lower end portion of said bolt shaft portion 27*a* and has a diameter larger than that of said bolt shaft portion 27*a*. A female thread portion 25*a* is screwed on an upper end portion of this bolt shaft portion 27*a*, and this is how the paper sheet push-up member 25 is coupled to the bolt shaft portion 27*a*.

The compression coil spring 26 is disposed concentrically with the bolt shaft portion 27*a*, with an upper end portion thereof being in contact with a lower surface of the paper sheet push-up member 25 and a lower end portion thereof being in contact with the bottom surface 24*b* of the housing concave portion 24*a*. In this way, the compression coil spring 26 elastically supports the paper sheet push-up member 25 in such a manner that the paper sheet push-up member 25 is movable in the up-down direction with respect to the bottom surface 24*b* of the housing concave portion 24*a*.

In a case where, in a state where the paper sheet stacking plate 24 has descended to a bottom portion of the paper sheet housing case 23 (that is, the large capacity paper feed cassette 22 has been demounted from the housing 10), the number of paper sheets in the paper sheet batch P on the paper sheet stacking plate 24 is higher than a prescribed number (for example 10 sheets), as shown in FIG. 5A, the compression coil spring 26 is compressed under the own weight of the paper sheet batch P. The paper sheet push-up member 25, therefore, is positioned not higher than the upper surface of the paper sheet stacking plate 24. On the other hand, in a case where the number of paper sheets in the paper sheet batch P on the paper sheet stacking plate 24 is not higher than the prescribed number, as shown in FIG. 5B, against the own weight of the paper sheet batch P, the compression coil spring 26 pushes up a front end portion of the paper sheet push-up member 25 at a center portion in a width direction thereof (a part of the paper sheet push-up member 25). As a result, a clearance C is created between a lowermost one of the paper sheets p and the upper surface of the paper sheet stacking plate 24. Thus, it is possible to facilitate a paper changing procedure by a user. That is, there is a problem that at the time of paper sheet changing by a user, in a case where the number of paper sheets in the paper sheet batch P remaining on the paper sheet stacking plate 24 is low, compared with a case where a sufficient number of the paper sheets p are remaining there, it is hard for the user to insert his/her finger(s) between a lowermost one of the paper sheets p and the paper sheet stacking plate 24 and thus to grasp the paper sheets p. With respect to this problem, in the above-described embodiment, as discussed above, in a case where the number of paper sheets in the paper sheet batch P on the paper sheet stacking plate 24 is not higher than a prescribed number, a part of a lowermost one of the paper sheets p is pushed up by the paper sheet push-up member 25, thereby creating the clearance C between said lowermost one of the paper sheets p and the paper sheet stacking plate 24, and this allows a user to insert his/her finger(s) in this clearance C and thus to securely grasp the paper sheets p remaining on the paper sheet stacking plate 24.

On the other hand, in a case where the number of paper sheets in the paper sheet batch P on the paper sheet stacking plate 24 is higher than the prescribed number, under the weight of the paper sheet batch P as a whole, a lowermost one of the paper sheets p is firmly pressed against the upper surface of the paper sheet stacking plate 24, and thus a user can easily grasp the paper sheet batch P as a whole with his/her hand. Based on this, in the above-described embodiment, in a case where the number of paper sheets p in the paper sheet batch P on the paper sheet stacking plate 24 is higher than the prescribed number, the compression coil spring 26 is compressed, so that the paper sheet push-up member 25 is positioned not higher than the upper surface of the paper sheet stacking plate 24. This is intended to prevent a lowermost one of the paper sheets p from being undesirably pushed up by the push-up member 25, which might result in formation of a crease or an indentation on the lowermost one of the paper sheets p.

Furthermore, in the above-described embodiment, an upper end surface of the paper sheet push-up member 25 is formed in a spherical surface shape. According to this configuration, compared with a case where the upper end surface of the paper sheet push-up member 25 is in a flat surface shape, when the paper sheet push-up member 25 comes in contact with a lowermost one of the paper sheets p, it is unlikely that a press-contact mark is formed on said lowermost one of the paper sheets p, and thus this configuration is preferable from the standpoint of maintaining paper sheet quality.

In the above-descried embodiment, in a state where the paper sheet housing case 23 is mounted in the housing 10, the paper sheet push-up member 25 is disposed to be positioned at an end portion on the front side in the paper sheet housing case 23, namely, an open-side end portion of the cassette housing space S. According to this configuration, when, in a paper sheet changing procedure, a user pulls out the paper sheet housing case 23 to the front side of the image forming apparatus 100, it is possible for the paper sheet push-up member 25 to be positioned on the closest side (front side) in the paper sheet housing case 23 as seen from the user. Thus, compared with a case where the paper sheet push-up member 25 is positioned on the farthest side (back side) as seen from a user, it is possible to facilitate the paper sheet changing procedure.

Embodiment 2

Figure 6:
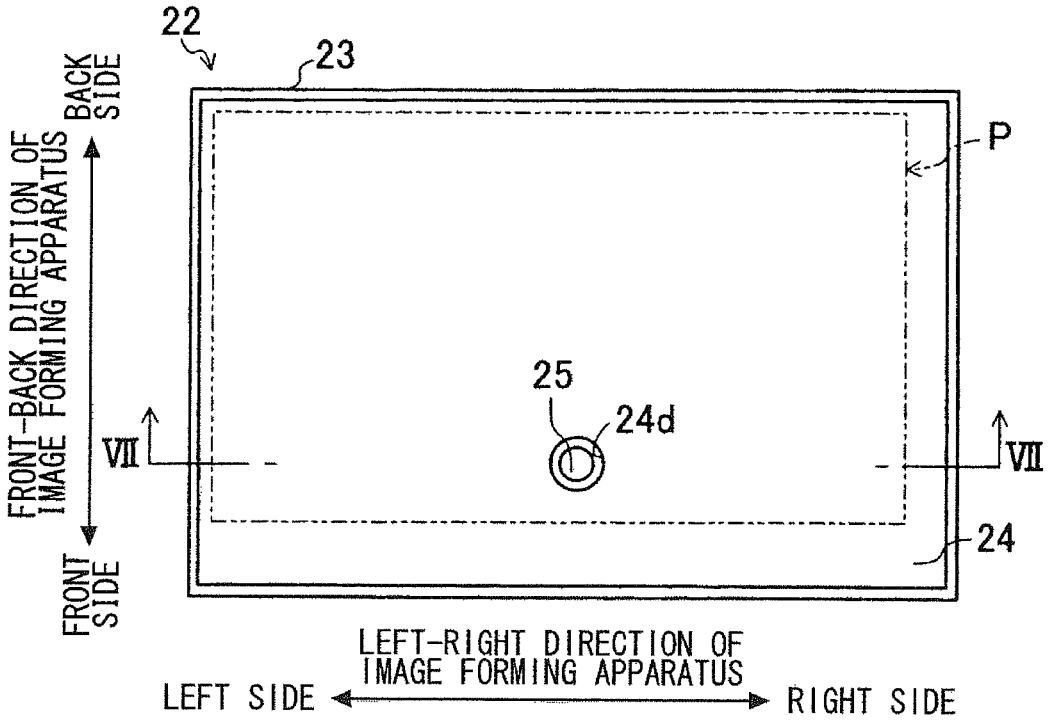
FIG. 6 is a view corresponding to FIG. 4, which shows Embodiment 2.
Figure 7A:
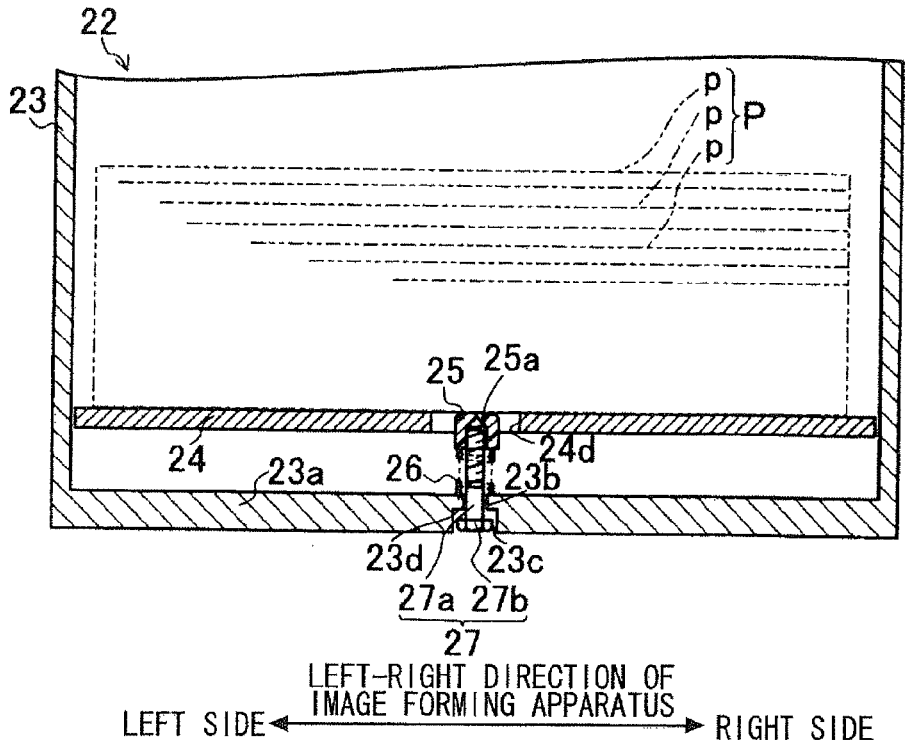
FIG. 7A is a sectional view taken along a line VII-VII in FIG. 6, which shows a case where the number of paper sheets in a paper sheet batch is higher than a prescribed number.
Figure 7B:
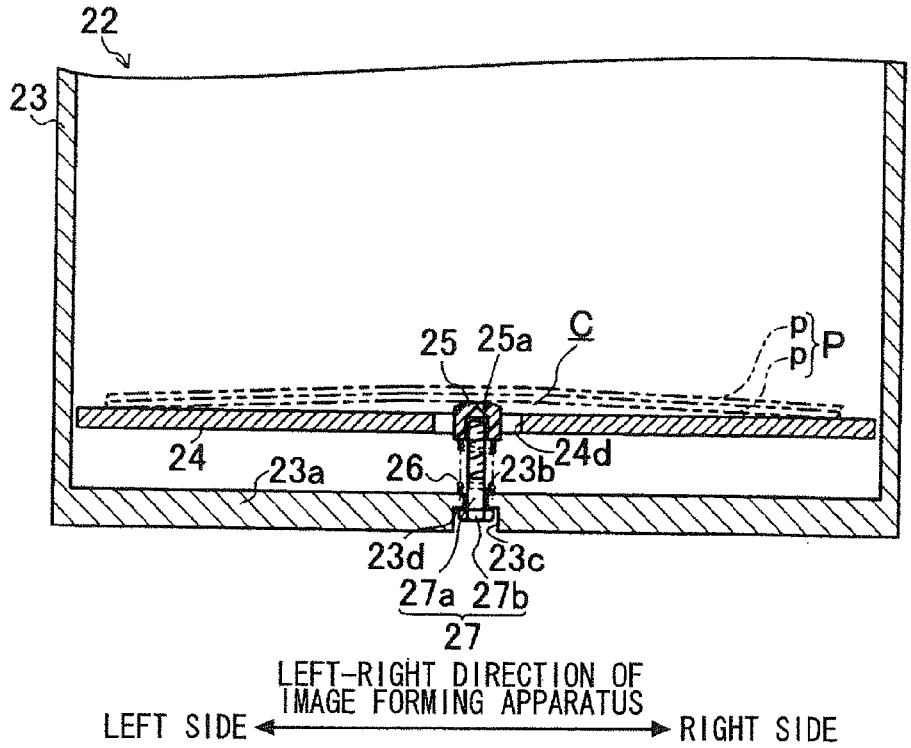
FIG. 7B is a sectional view taken along the line VII-VII in FIG. 6, which shows a case where the number of paper sheets in a paper sheet batch is not higher than a prescribed number.

FIG. 6, FIG. 7A, and FIG. 7B show Embodiment 2. This embodiment is different from Embodiment 1 described above in terms of a push-up mechanism (a push-up member driving device) of a paper sheet push-up member 25. In these figures, like reference symbols refer to corresponding parts having the same configurations as those in FIG. 4, FIG. 5A, and FIG. 5B, detailed descriptions of which are omitted.

That is, in this embodiment, via a compression coil spring 26, the paper sheet push-up member 25 is elastically supported to a bottom wall portion 23*a* of a paper sheet housing case 23. The compression coil spring 26 supports the paper sheet push-up member 25 in such a manner that the paper sheet push-up member 25 is movable in an up-down direction with respect to the bottom wall portion 23. In a planar view, the paper sheet push-up member 25 is disposed at a position corresponding to an insertion hole 24*d* that is formed through a paper sheet stacking plate 24. The insertion hole 24*d* is formed at a front end portion in an area on the paper sheet stacking plate 24 on which paper sheets are placed, at a center portion in a left-right direction therein. The paper sheet push-up member 25 is screwed on an upper end portion of a bolt 27 that extends in an up-down direction so as to be coupled to the bolt 27. The bolt 27 is inserted from below through a through hole 23*b* in the bottom wall portion 23*a* of the paper sheet housing case 23 and protrudes into the paper sheet housing case 23. The compression coil spring 26 is disposed concentrically with this bolt 27. A countersunk hole 23*c* for housing a head portion 27*b* of the bolt 27 is formed at a lower surface of the bottom wall portion 23*a* of the paper sheet housing case 23.

FIG. 7A shows a state where, in a case where the paper sheet stacking plate 24 has been moved to a standby position by a lift-up mechanism 90, the number of paper sheets in a paper sheet batch P on the paper sheet stacking plate 24 is higher than the prescribed number. In this state, since the compression coil spring 26 is compressed under the own weight of said paper sheet batch P, the paper sheet push-up member 25 is positioned not higher than an upper surface of the paper sheet stacking plate 24. On the other hand, as shown in FIG. 7B, in a case where the number of paper sheets in the paper sheet batch P is not higher than the prescribed number, against the own weight of said paper sheet batch P, the compression coil spring 26 pushes up the paper sheet push-up member 25 to such an extent that the head portion 27*b* of the bolt 27 comes in contact with a seating surface 23*d* of the countersunk hole 23*c*. As a result, an upper end portion of the paper sheet push-up member 25 protrudes upward beyond the paper sheet stacking plate 24, so that the paper sheet push-up member 25 pushes up a lower surface of a lowermost one of paper sheets p, thereby creating a clearance C between the lower surface of the lowermost one of the paper sheets p and the upper surface of the paper sheet stacking plate 24. This allows a user to insert his/her finger(s) in this clearance C and thus to securely grasp the paper sheets p remaining on the paper sheet stacking plate 24. In this way, Embodiment 2 described above can provide an effect similar to that of Embodiment 1 described above.

Embodiment 3

Figure 8A:
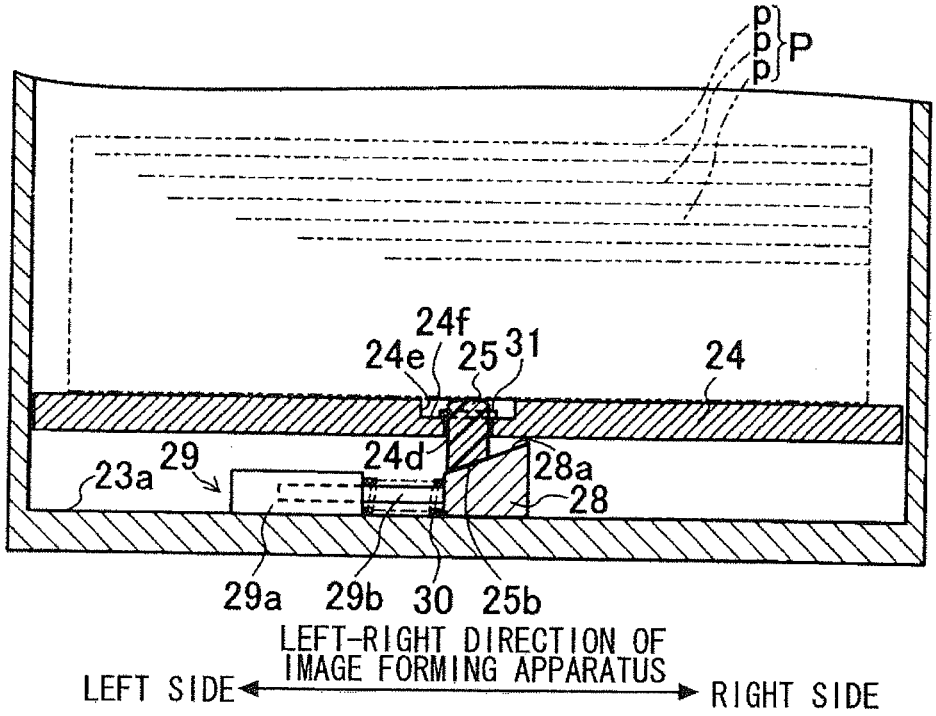
FIG. 8A is a view corresponding to FIG. 7A, which shows Embodiment 3.
Figure 8B:
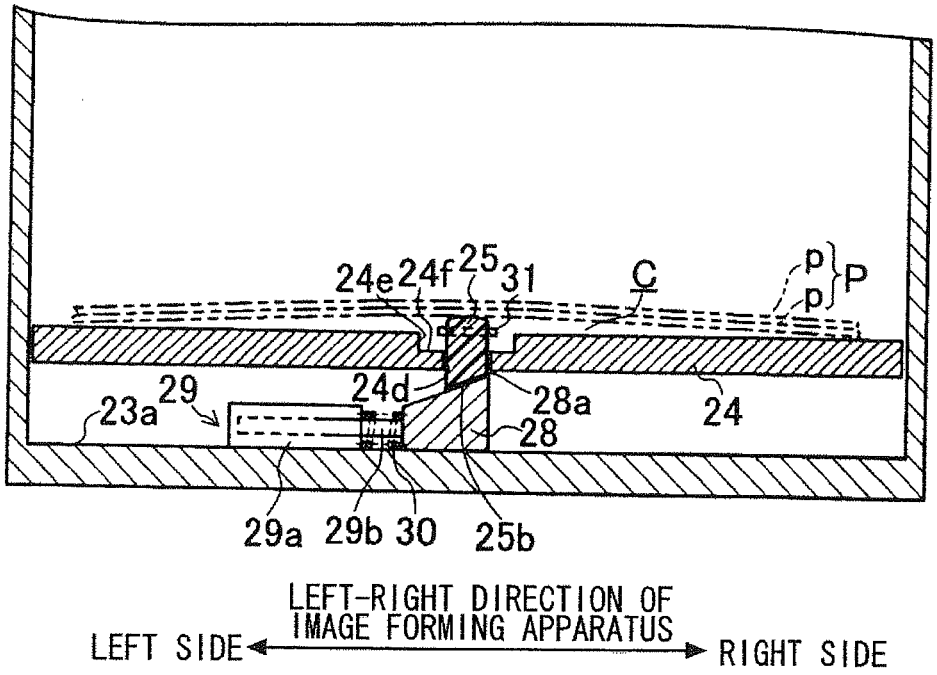
FIG. 8B is a view corresponding to FIG. 7B, which shows Embodiment 3.

FIG. 8A and FIG. 8B show Embodiment 3. This embodiment is different from Embodiment 2 described above in terms of a push-up mechanism (a push-up member driving device) of a paper sheet push-up member 25. In these figures, like reference symbols refer to corresponding parts having the same configurations as those in FIG. 7A and FIG. 7B, detailed descriptions of which are omitted.

In this embodiment, in a state of being inserted through an insertion hole 24*d* that is formed through a paper sheet stacking plate 24, the paper sheet push-up member 25 is held by a snap ring (corresponding a holding member) 31. The snap ring 31 is fitted to a ring groove at an upper end portion of the paper sheet push-up member 25. The insertion hole 24*d* is formed at a front end portion in an area on the paper sheet stacking plate 24 on which a paper sheet batch P is placed, at a center portion in a left-right direction therein. At an upper surface of the paper sheet stacking plate 24, a countersunk hole 24*e* is formed concentrically with the insertion hole 24*d*, and the snap ring (corresponding to the holding member) 31 is housed in the countersunk hole 24*e* in such a manner as to be in contact with a bottom surface 24*f* of the countersunk hole 24*e*. At a lower end portion of the paper sheet push-up member 25, a wedge surface 25*b* is formed that is inclined upward from a left side toward a right side. In a state where the paper sheet stacking plate 24 has descended to a standby position, this wedge surface 25*b* comes in contact with a wedge surface 28*a* of a contact member 28 that is disposed on a lower side of the paper sheet push-up member 25. Similarly to the wedge surface 25*b* of the paper sheet push-up member 25, the wedge surface 28*a* of this contact member 28 is inclined upward from the left side toward the right side. The contact member 28 is slidable in a left-right direction along a bottom wall portion 23*a* of a paper sheet housing case 23. By an electromagnetic solenoid 29, the contact member 28 is driven between a first position (see FIG. 8A) and a second position (see FIG. 8B) on the bottom wall portion 23*a*. The electromagnetic solenoid 29 is controlled to be activated by a controller 98. The electromagnetic solenoid 29 and the controller 98 constitute a contact member driving device that drives the contact member 28.

Based on a detection signal from a rotation angle detection sensor 97, the controller 98 calculates the number of paper sheets in a paper sheet batch P on the paper sheet stacking plate 24. In a case where the calculated number of paper sheets is higher than a prescribed number, the controller 98 causes a movable core 29*b* of the electromagnetic solenoid 29 to extend by a biasing force of a coil spring 30 with respect to a casing 29*a* that is fastened to the bottom wall portion 23*a* so that the contact member 28 is positioned at the first position, and in a case where the calculated number of paper sheets is not higher than the prescribed number, the controller 98 applies electric power to the electromagnetic solenoid 29 to cause the movable core 29*b* to contract against the biasing force of the coil spring 30 so that the contact member 28 is positioned at the second position.

In a state where the contact member 28 is at the first position, as shown in FIG. 8A, the paper sheet push-up member 25 is positioned not higher than the upper surface of the paper sheet stacking plate 24. On the other hand, when the contact member 28 is moved from the first position to the second position by the electromagnetic solenoid 29, by a wedge effect, the paper sheet push-up member 25 is pushed up upward by the contact member 28. As a result, as shown in FIG. 8B, an upper end portion of the contact member 28 protrudes upward beyond the upper surface of the paper sheet stacking plate 24 to push up upward a lowermost one of paper sheets p. Thus, there is provided a clearance C between a lower surface of the lowermost one of paper sheets p and the upper surface of the paper sheet stacking plate 24. This allows a user to insert his/her finger(s) in this clearance C and thus to securely grasp the paper sheets p remaining on the paper sheet stacking plate 24. In this way, Embodiment 3 described above can provide an effect similar to that of Embodiment 1 and Embodiment 2 described above. In addition, in Embodiment 3 described above, the paper sheet push-up member 25 is caused to ascend and descend by utilizing a driving force of the electromagnetic solenoid 29, and thus compared with a case of using the compression coil spring 26, an ascending and descending operation of the paper sheet push-up member 25 can be executed as required. For example, when the paper sheet housing case 23 is pulled out to a front side of the image forming apparatus 100, the solenoid 29 can be activated to cause the paper sheet push-up member 25 to ascend. Furthermore, a push button or the like to activate the solenoid 29 may be provided in the paper sheet housing case 23. By adopting control in which one push on the push button activates the solenoid 29 for a prescribed length of time, it is possible to operate the solenoid 29 only when the paper sheets p are taken out.

Embodiment 4

Figure 9A:
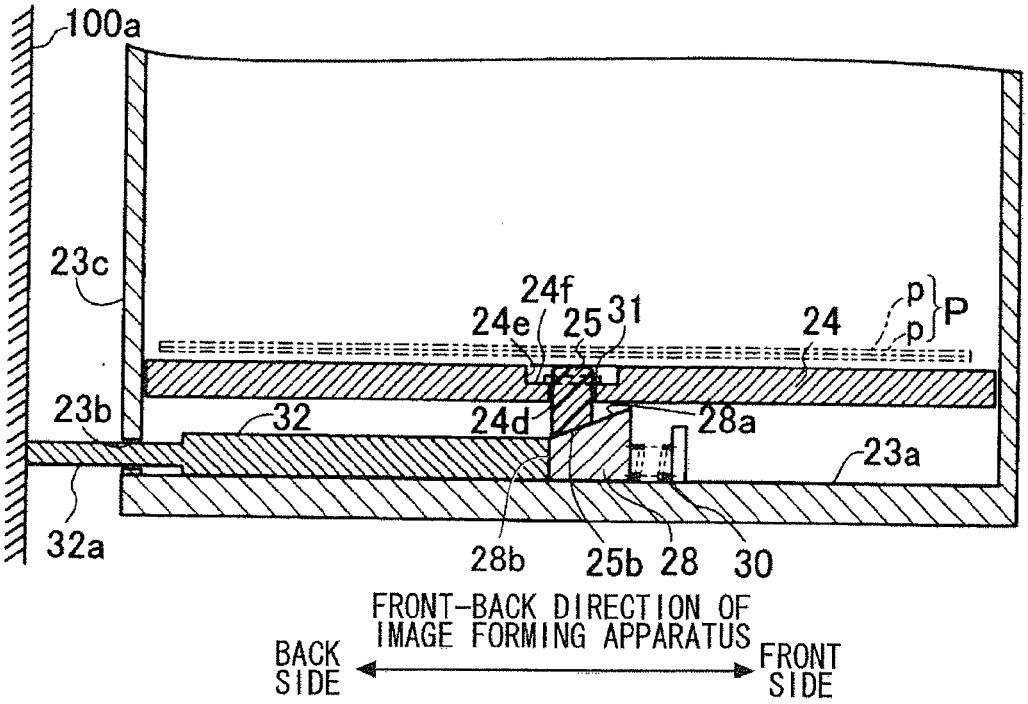
FIG. 9A is a view corresponding to FIG. 8A, which shows Embodiment 4.
Figure 9B:
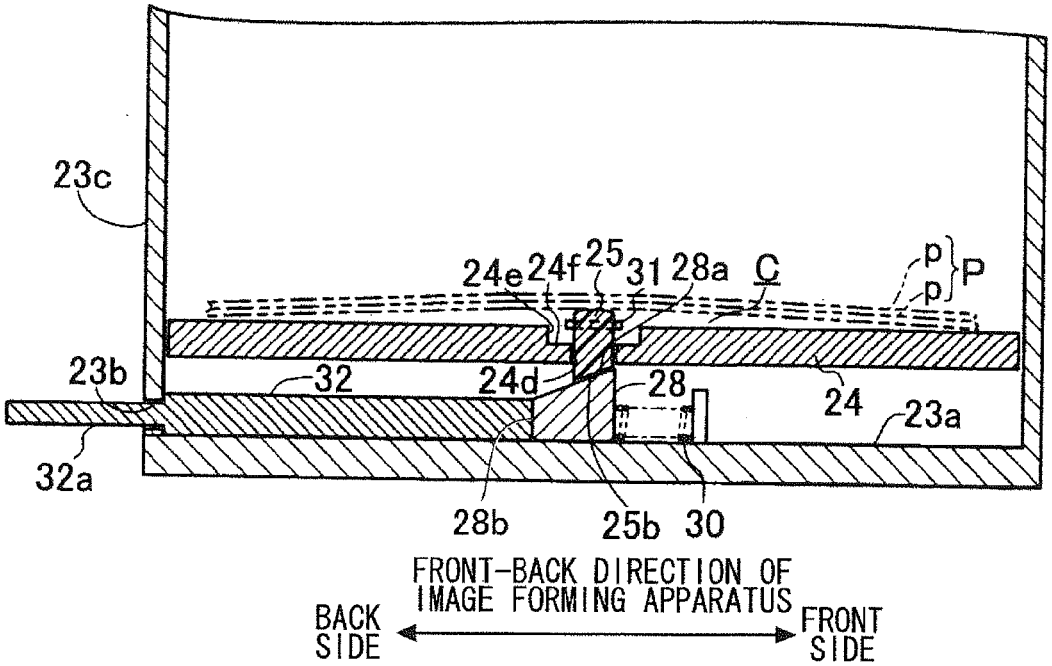
FIG. 9B is a view corresponding to FIG. 8B, which shows Embodiment 4.

FIG. 9A and FIG. 9B show Embodiment 4. This embodiment is different from Embodiment 3 described above in terms of a push-up unit (a push-up member driving device) of a paper sheet push-up member 25. In these figures, like reference symbols refer to corresponding parts having the same configurations as those in FIG. 8A and FIG. 8B, detailed descriptions of which are omitted.

In this embodiment, the paper sheet push-up member 25 has the same configuration as that in Embodiment 3. Furthermore, a contact member 28 also has the same shape as that in Embodiment 3, whereas a moving direction of the contact member 28 and how the contact member 28 is moved are different. As shown in FIG. 9A and FIG. 9B, in this embodiment, the contact member 28 is supported so as to move on a bottom surface 23*a* in a front-back direction of the image forming apparatus 100. Further, in front of the contact member 28, a coil spring 30 is provided so as to bias the contact member 28 backward. Furthermore, a rod 32 is linked to a side surface 28*b* of the contact member 28 on a back side thereof. A small diameter portion 32*a* is formed at a tip end of the rod 32 and is movably inserted through a through hole 23*b* that is formed through a back wall 23*c* of a paper sheet housing case 23.

As shown in FIG. 9A, in a state where the paper sheet housing case 23 is housed in the image forming apparatus 100, a tip end of the small diameter portion 32*a* of the rod 32 comes in contact with a back frame 100*a* of the image forming apparatus 100, thus causing the rod 32 to move, together with the contact member 28, frontward relatively to the paper sheet housing case 23. Therefore, in a state where the paper sheet housing case 23 is housed in the image forming apparatus 100, the contact member 28 is always housed in a countersunk hole 24*f*. As shown in FIG. 9B, when the paper sheet housing case 23 is pulled out to a front side of the image forming apparatus 100, in a case where the number of paper sheets p placed on a paper sheet stacking plate 24 is not higher than a prescribed number, by a biasing force of the coil spring 30, the rod 32 and the contact member 28 moves integrally with each other backward relatively to the paper sheet housing case 23. This causes the contact member 28 to ascend to bring up the paper sheets p, thereby creating a clearance C between the paper sheets p and an upper surface of the paper sheet stacking plate 24.

In this embodiment, only in a case where the paper sheet housing case 23 is pulled out to the front side of the image forming apparatus 100, the contact member 28 pushes up the paper sheets p, and thus in no case are the paper sheets p kept in a pushed up state for a long time. This prevents the paper sheets p from developing a tendency of being bent.

Other Embodiments

While in Embodiment 1 described above, the lift-up mechanism 90 is configured such that, in a case where the paper sheet housing case 23 is demounted from the housing 10, the paper sheet stacking plate 24 caused to descend to the standby position, there is no limitation thereto. The lift-up mechanism 90 may be configured such that, even after the paper sheet housing case 23 has been demounted from the housing 10, the paper sheet stacking plate 24 is held at a position to which it has ascended.

Figure 10:
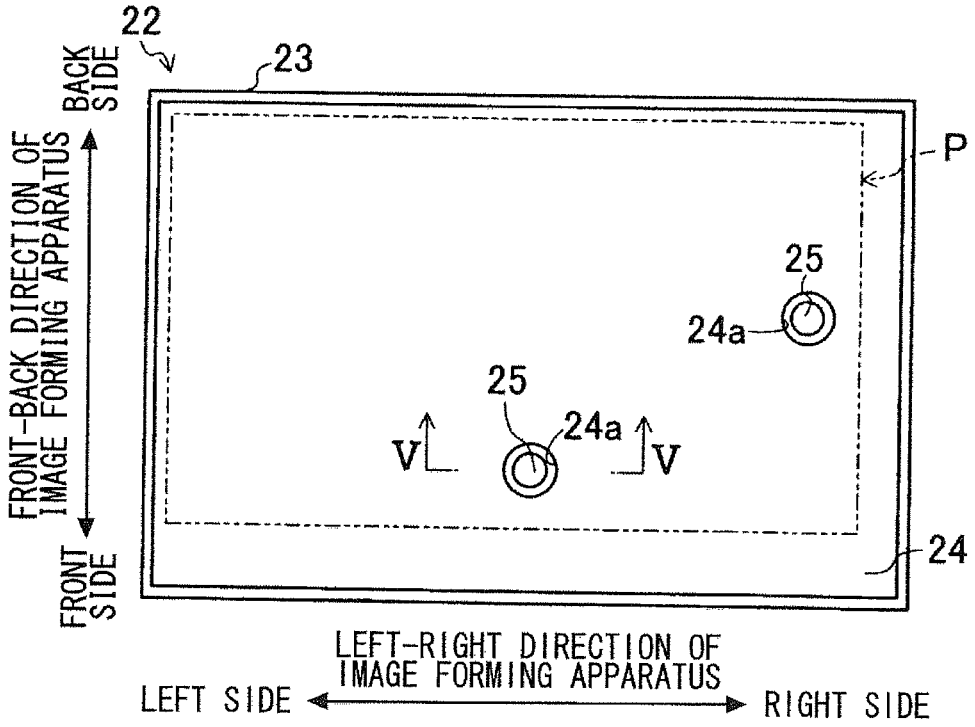
FIG. 10 is a view corresponding to FIG. 4, which shows another embodiment.

While in the above-described embodiments, the paper sheet push-up member 25 is provided at one position in the paper sheet housing case 23, there is no limitation thereto. For example, as shown in FIG. 10, the paper sheet push-up member 25 may be provided at two positions in the paper sheet housing case 23.

While in the above-described embodiments, in a case where the number of paper sheets in the paper sheet batch P on the paper sheet stacking plate 24 is not higher than a prescribed number, a part of the paper sheet push-up member 25 is made to protrude upward beyond the upper surface of the paper sheet stacking plate 24, there is not limitation thereto. For example, the entire paper sheet push-up member 25 may be made to protrude upward beyond the upper surface of the paper sheet stacking plate 24.

While the above-described embodiments describe an example in which the image forming apparatus 100 is a copy machine, there is no limitation thereto. The image forming apparatus 100 may be, for example, a printer, a multi-functional peripheral, or the like.

The paper feed device of the present application is a device included in the paper feed portion 20 of the embodiments of the present application and has a configuration including the paper sheet housing case 23, the paper sheet stacking plate 24, and the lift-up mechanism 90 and having the paper sheet push-up member 25 and the push-up member driving device. Furthermore, the paper sheet push-up member 25 corresponds to the push-up member of the present application.

As described thus far, the paper feed device of the present disclosure includes the paper sheet housing case, the paper sheet stacking plate, and the lift-up mechanism and is configured such that, in a case where the number of paper sheets in a paper sheet batch on the paper sheet stacking plate is not higher than a prescribed number, by the paper sheet push-up member and the push-up member driving device, a clearance is created between a lower surface of a lowermost one of the paper sheets and an upper surface of the paper sheet stacking plate. Thus, according to the present disclosure, there is provided a paper feed device that, even in a case where the number of paper sheets remaining on the paper sheet stacking plate is low, allows paper sheet changing to be facilitated.

Furthermore, in the paper feed method for the paper feed device having the above-described configuration (the paper feed method of the present application), via the push-up member driving device that drives the paper sheet push-up member, in a case where the number of paper sheets in a paper sheet batch on the paper sheet stacking plate is higher than a prescribed number, the paper sheet push-up member is caused to be positioned not higher than an upper surface of the paper sheet stacking plate, and in a case where the number of paper sheets in the paper sheet batch on the paper sheet stacking plate is not higher than the prescribed number, at least a part of the paper sheet push-up member is made to protrude upward beyond the upper surface of the paper sheet stacking plate so that a part of a lower surface of a lowermost one of the paper sheets in the paper sheet batch placed on the paper sheet stacking plate is pushed up from below by the paper sheet push-up member, thereby creating a clearance between the lower surface of the lowermost one of the paper sheets and the upper surface of the paper sheet stacking plate. Thus, according to the present disclosure, there is provided a paper feed method that, even in a case where the number of paper sheets remaining on the paper sheet stacking plate is low, allows paper sheet changing to be facilitated.

As described in the foregoing, the present disclosure is useful with regard to a paper feed device and provides a paper feed device and a paper feed method that are useful particularly for a paper feed device that is incorporated in an image forming apparatus such as a copy machine, a printer, a multi-functional peripheral, or the like.

What is claimed is:

1. A paper feed device, comprising:

a paper sheet housing case that is open upward;

a paper sheet stacking plate that is provided in the paper sheet housing case in such a manner as to be movable in an up-down direction, on an upper surface of which a batch of paper sheets are placed in a state of being stacked in the up-down direction; and a lift-up mechanism that causes the paper sheet stacking plate to ascend as a number of the paper sheets on the paper sheet stacking plate decreases so that an uppermost one of the paper sheets in the paper sheet batch on the paper sheet stacking plate is positioned at a prescribed paper feed height, wherein the paper feed device further comprises:

a push-up member for pushing up from below the paper sheet batch on the paper sheet stacking plate; and a push-up member driving device that, in a case where the number of paper sheets in the paper sheet batch on the paper sheet stacking plate is higher than a prescribed number, causes the push-up member to be positioned not higher than the upper surface of the paper sheet stacking plate, and in a case where the number of paper sheets in the paper sheet batch on the paper sheet stacking plate is not higher than the prescribed number, makes at least a part of the push-up member protrude upward beyond the upper surface of the paper sheet stacking plate so that a part of a lower surface of a lowermost one of the paper sheets in the paper sheet batch placed on the paper sheet stacking plate is pushed up from below by the push-up member, thereby creating a clearance between the lower surface of the lowermost one of the paper sheets and the upper surface of the paper sheet stacking plate, a pick-up roller for feeding out the uppermost one of the paper sheets to outside the paper sheet housing case is provided at the paper feed position, the paper sheet housing case is mountable and demountable with respect to a housing that houses an image forming portion that forms an image on a paper sheet fed out by the pick-up roller, the lift-up mechanism is configured to, when the paper sheet housing case is demounted from the housing, cause the paper sheet stacking plate to descend to be positioned at a prescribed standby position below the paper feed position, at a prescribed position on the paper sheet stacking plate, a through hole is formed to penetrate through the paper sheet stacking plate in the up-down direction, on a bottom wall portion of the paper sheet housing case, in a planar view, the push-up member is disposed at a position corresponding to the through hole, the push-up member driving device includes a compression coil spring that elastically supports the push-up member in such a manner that the push-up member is movable in the up-down direction with respect to the bottom wall portion of the paper sheet housing case, the compression coil spring is configured such that, in a case where the paper sheet stacking plate has been moved to the standby position by the lift-up mechanism, a number of paper sheets in a paper sheet batch on the paper sheet stacking plate is higher than the prescribed number, the compression coil spring is compressed under an own weight of the paper sheet batch, so that the push-up member is positioned not higher than the upper surface of the paper sheet stacking plate, and in a case where the number of paper sheets in the paper sheet batch is not higher than the prescribed number, against the own weight of the paper sheet batch, the compression coil spring pushes up the push-up member so that at least a part of the push-up member protrudes upward beyond the upper surface of the paper sheet stacking plate, thereby creating a clearance between a lower surface of the lowermost one of the paper sheets and the upper surface of the paper sheet stacking plate, and when the paper sheet stacking plate is moved from the standby position to the paper feed position by the lift-up mechanism, the upper surface of the paper sheet stacking plate moves up away from the push-up member.

2. The paper feed device according to claim 1, wherein the paper sheet stacking plate is formed of a rectangular plate somewhat larger than a prescribed size of paper sheets housed in the paper sheet housing case.

3. The paper feed device according to claim 1, wherein the lift-up mechanism comprises:

a left-right pair of wires that is connected to the paper sheet stacking plate;

a left-right pair of intermediate pulleys on which the wires are wound;

a driving pulley on which the wires are wound;

a driving shaft that is linked to the driving pulley in such a manner as to be rotatable integrally with the driving pulley; and a motor that is fastened in the housing and that is linked to the driving shaft when the paper sheet housing case is mounted in the housing, wherein the paper sheet stacking plate is moved to the paper feed position by rotation of the motor.

* * * * *